US009252520B1

(12) United States Patent
Weiden

(10) Patent No.: US 9,252,520 B1
(45) Date of Patent: Feb. 2, 2016

(54) STACKED SPRING TERMINALS

(71) Applicant: SCHNEIDER ELECTRIC USA, INC., Palatine, IL (US)

(72) Inventor: Conrad S. Weiden, Chapel Hill, NC (US)

(73) Assignee: SCHNEIDER ELECTRIC USA, INC., Schaumburg, IL (US)

( * ) Notice: Subject to any disclaimer, the term of this patent is extended or adjusted under 35 U.S.C. 154(b) by 0 days.

(21) Appl. No.: 14/572,148

(22) Filed: Dec. 16, 2014

(51) Int. Cl.
*H01R 13/62* (2006.01)
*H01R 13/193* (2006.01)

(52) U.S. Cl.
CPC ..... *H01R 13/193* (2013.01)

(58) Field of Classification Search
CPC ..... H01R 13/193; H01R 4/4845
USPC ..... 439/226, 835, 864, 656
See application file for complete search history.

(56) References Cited

U.S. PATENT DOCUMENTS 8,444,443 B2 * 5/2013 Schafmeister ..... H01R 4/4836 439/441

* cited by examiner

*Primary Examiner* — Abdullah Riyami
*Assistant Examiner* — Thang Nguyen
(74) *Attorney, Agent, or Firm* — Locke Lord LLP

(57) ABSTRACT

A multi-wire electrical connector system is provided for electrical equipment, such as circuit breaker, contactor or electrical switches. The connector system includes a plurality of stacked spring-loaded connector modules, and a single actuator to simultaneously operate all of the stacked connector modules to an open position or a closed position. Each connector module includes a housing, an isolated terminal and a spring. The terminal has a fixed conductive member. The housing is movable relative to the fixed conductive member between the open and closed positions. In the open position, an electrical wire can be inserted into or removed from a housing of each connector module. In the closed position, an electrical wire is clamped against a respective terminal in each connector module.

13 Claims, 4 Drawing Sheets

STACKED SPRING TERMINALS

FIELD

The present disclosure is related to a system and method of simultaneously making electrical connections or disconnections for multiple isolated terminals.

BACKGROUND

Electrical equipment can include multiple isolated terminals which are connectable to separate electrical wires. Each isolated terminal typically has its own connector mechanism, which is operated to connect an electrical wire to the terminal or disconnect an electrical wire from the terminal. Thus, the terminals can require a substantial amount of parts and materials as well as a substantial area (e.g., a front face area) in the electrical equipment to accommodate them. Furthermore, it is time consuming to individually connect or disconnect an electrical wire to or from, respectively, each and every terminal of the electrical equipment.

SUMMARY

To address these and other shortcomings, there is provided a multi-wire electrical connector system, which is able to simultaneously operate a plurality of isolated terminals to connect electrical wires to the isolated terminals or to disconnect them from the isolated terminals. The connector system employs stackable spring-loaded connector modules with isolated terminals, which are housed in a casing. The connector system is operated using a single actuator such as a lever, screw or cam. Accordingly, the connector system, which is stackable, can provide for substantial space saving for terminal configurations in electrical equipment, particularly with respect to those which are subject to size and space constraints. For example, the connector system is particularly useful with electrical equipment that has a smaller width or length for its terminal requirements than normal terminal configurations. The connector system can also be incorporated into various types of electrical equipment, such as a circuit breaker, contactor and electrical switch or any equipment that requires multiple electrical connections.

Each connector module can include a housing, an isolated terminal and a spring. The terminal has a fixed conductive member, and the housing is movable relative to the fixed conductive member. In each connector module, the spring is arranged inside the housing between a side of the housing (e.g., an interior wall) and the fixed conductive member, and is used to apply a spring force against the housing. The single actuator is used to simultaneously operate all of the stacked connector modules to an open position or a closed position. The open position allows a separate electrical wire to be inserted into or removed from a housing of each connector module. For example, in the open position, a gap is provided in each connector module between the terminal and one side of the housing, e.g., a clamping portion or body. The closed position allows a separate electrical wire to be clamped against a terminal in each connector module. For example, in the closed position, an electrical wire can be clamped between the terminal and one side of the housing in each connector module. In operation, the single actuator can apply an actuating force to the stacked connector modules to move the housing of each connector module relative to a respective fixed conductive member into the open position or the closed position.

Furthermore, the multi-wire electrical connector system can incorporate one or more shuttles, which are formed of a dielectric material (e.g., plastic), to isolate adjacent connector modules or provide a buffer between a connector module and other components of the system. For example, a shuttle can be arranged on one end or both ends of the stacked spring-loaded connector modules or between any two adjacent connector modules.

DETAILED DESCRIPTION OF THE EXAMPLE EMBODIMENTS

The present disclosure provides a multi-wire electrical connector system, which employs stackable spring-loaded connector modules with isolated terminals. The stacked connector modules are housed together in a casing and operated using a single actuator. The multi-wire electrical connector system is able to simultaneously operate the isolated terminals to connect electrical wires to the isolated terminals or to disconnect them from the isolated terminals. Various embodiments of a multi-wire electrical connector system are described in detail below with reference to the Figures.

Figure 2:
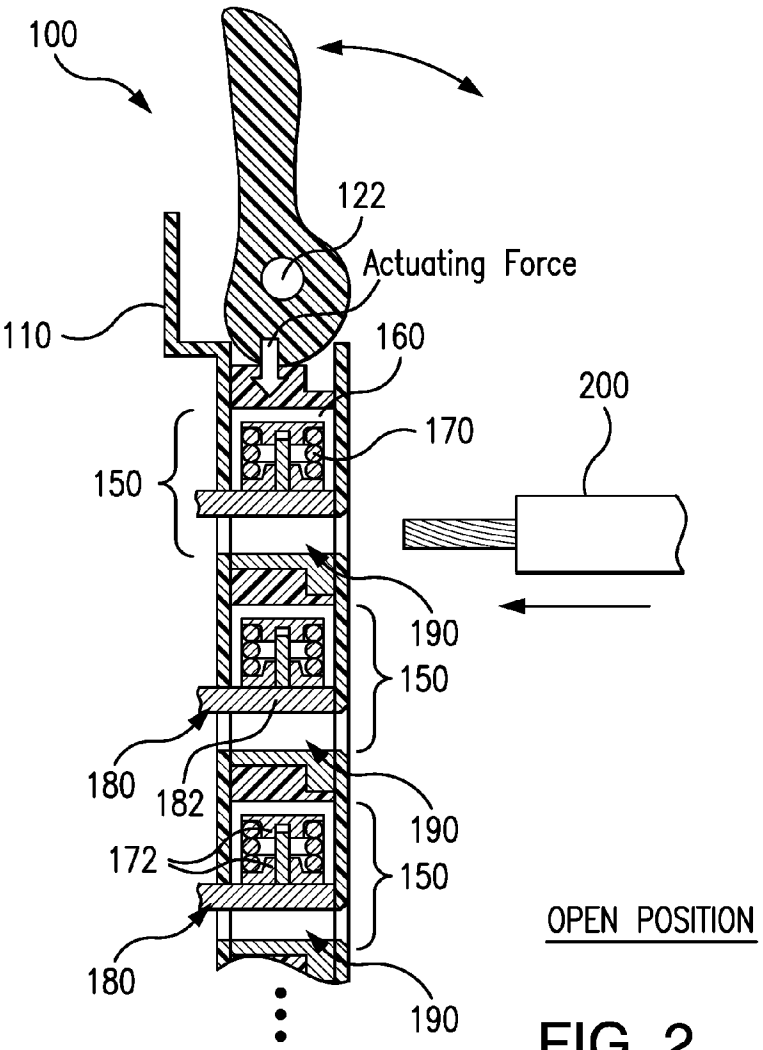
FIG. 2 illustrates a partial view of the multi-wire electrical connector system of FIG. 1 in an open position in accordance with the first embodiment of the present disclosure.
Figure 1:
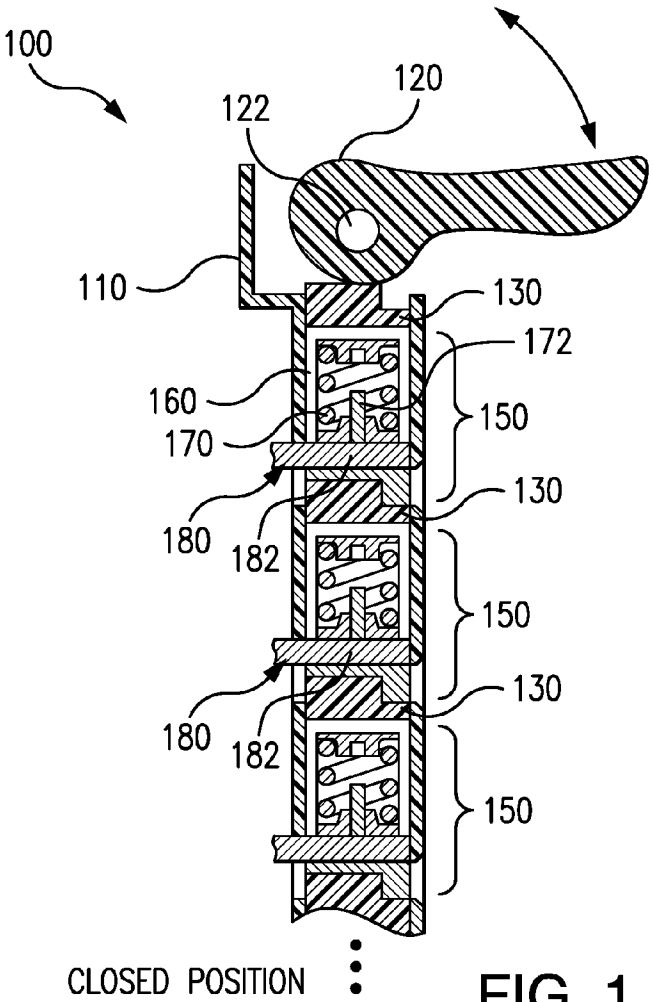
FIG. 1 illustrates a partial cross-sectional view of a multi-wire electrical connector system with a plurality of stacked connector modules in a closed position in accordance with a first embodiment of the present disclosure.

FIGS. 1 and 2 illustrate a multi-wire electrical connector system 100 in accordance with a first embodiment of the present disclosure. The connector system 100 includes a plurality of stackable spring-loaded connector modules 150 with isolated terminals 180, which are housed in a casing 110. The connector system 100 further includes a single actuator 120 to operate the stacked connector modules 150 to an open position or a closed position. In this example, the single actuator 120 is a lever that pivots around a pin 122 connected to the casing 110. As shown in FIG. 1, the single actuator 120 is operable in one direction to move the stacked connector modules 150 relative to the casing 110 to connect an electrical wire to each isolated terminal of the connector modules in the closed position. As shown in FIG. 2, the single actuator 120 is operable in an opposite direction to move the stacked connector modules 150 relative to the casing 110 to disconnect or allow disconnection of an electrical wire from each isolated terminal of the connector modules in the open position.

Figure 3:
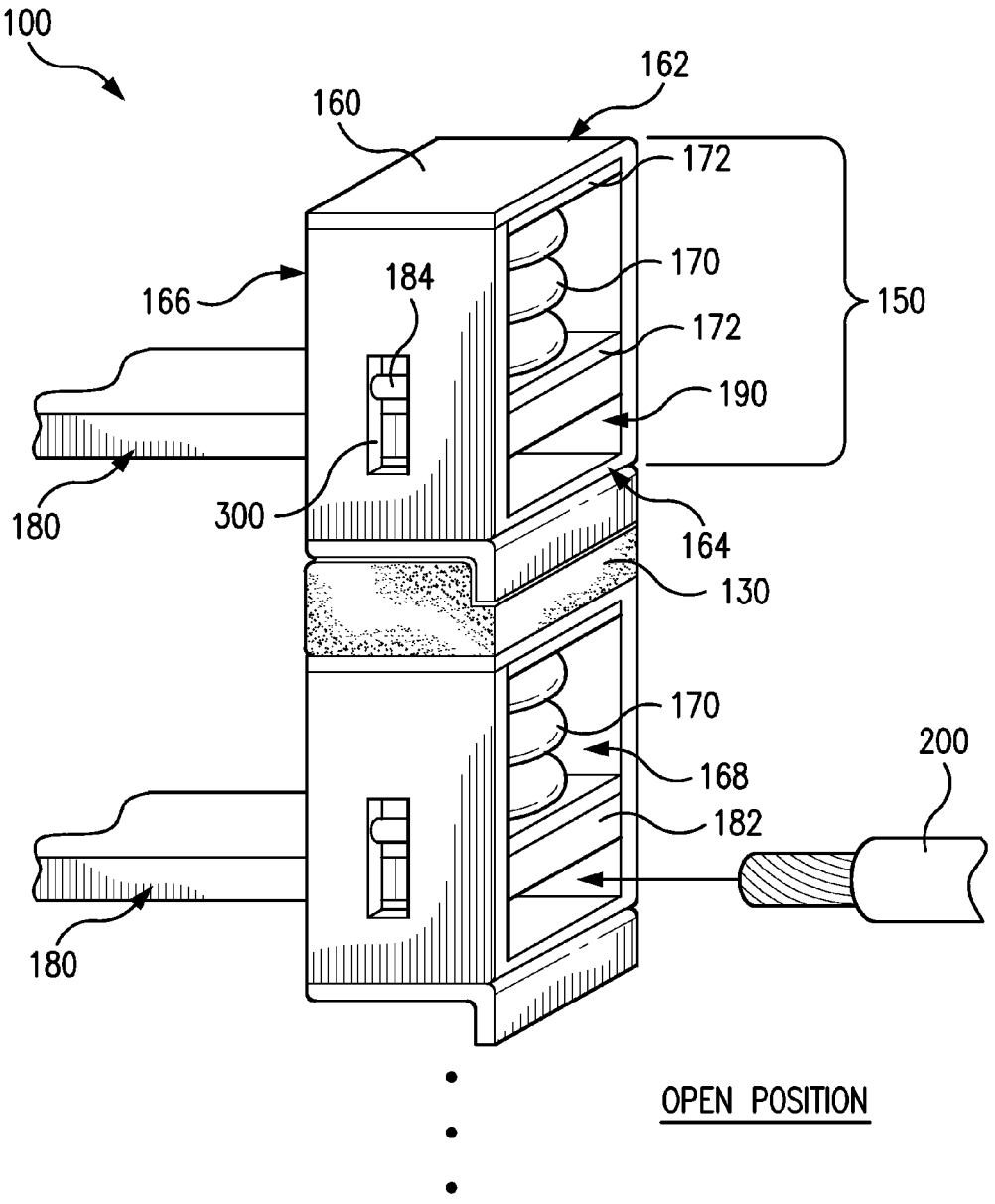
FIG. 3 illustrates a left side perspective view of the stacked connector modules, without a casing, of the multi-wire electrical connector system of FIG. 2 in the open position in accordance with the first embodiment of the present disclosure.

As shown in FIG. 3, each connector module 150 is a spring-loaded assembly, which is configured to clamp an electrical wire 200 against a corresponding terminal 180 or portion thereof. In this example, each connector module 150 includes a spring 170 and a conductive member 182 of a respective terminal 180, which are housed together in a module housing 160. The conductive member 182 of each of the terminals 180 is fixed relative to the casing 110. The housing 160 of each connector module 150 is movable relative to the casing 110 and corresponding conductive member 182.

The housing 160 includes a first side 162 (e.g., a top) and an opposite second side 164 (e.g., a bottom), and two opposing open sides 166 and 168. In each connector module 150, the conductive member 182 of the terminal 180 extends into the housing 160 through one of the two open sides, in this case the open side 166. The housing 160 is formed of a rigid material, such as steel or plastic, and can have a rectangular cross-section. To limit movement of the housing 160 relative to the fixed conductive member 182, the conductive member 182 includes or is connected to a stop 184 which extends through a slot 300 on the housing 160. The dimensions of the stop 184 and the slot 300 can be configured to control a range of movement available to the housing 160 relative to the conductive member 182.

Turning back to FIGS. 1 and 2, the connector module 150 can also include a spring holder 172 for supporting the spring 170, such as a compression spring, when housed in the housing 160. The spring holder 172 can include a cap, which has a T-shaped cross-section, arranged on each end of the spring 170. The spring holder 172 is a component which can be connected to the housing 160 or formed as part of the housing 160 to retain the spring 170 therein, or not connected to the housing 160. Other suitable types of spring holders can be used depending on the type of spring to be used in the connector module 150.

Furthermore, the connector system 100 can incorporate one or more shuttles 130 to isolate one connector module 150 from another connector module 150 in the stack of connector modules 150 or from other components of the connector system 100. The shuttles 130 act as a buffer and can be formed of a durable dielectric material (e.g., plastic) to reduce wear and friction to the connector modules 150 of the connector system 100. For example, as shown, the connector system 100 can include a shuttle 130 between the actuator 120 and a top connector module 150 from the stacked connector modules 150, and a shuttle 130 between adjacent connector modules 150.

An example operation of the connector system 100 is described below with reference to FIGS. 1-3. For example, when the actuator 120 is operated in one direction toward the open position (as shown in FIGS. 2 and 3), the actuator 120 contacts and applies an actuating force against one end of the stacked connector modules 150. When the actuating force of the actuator 120 exceeds the sum of the spring forces from the springs 170 of the connector modules 150, the housings 160 of the stacked connector modules 120 move together relative to the casing 110 and the conductive members 182 of the terminals 180, toward the open position. At the open position, the springs 170 of the connector modules 150 are compressed. As a result, a gap 190 is formed between the conductive member 182 and the second side 164 of the housing 160 of each connector module 150. In this way, an electrical wire can be inserted into or removed from the gap 190 of each connector module 150 in the open position.

To operate the connector system 100 to the closed position, the actuator 120 is operated in the opposite direction, as shown in FIG. 1, to reduce or eliminate the actuating force against the stacked connector modules 150 of the connector system 100. When the actuating force of the actuator 120 is less than the sum of the spring forces from the springs 170 of the connector modules 150, the housings 160 of the stacked connector modules 120 move together relative to the casing 110 and their conductive members 182, back toward the closed position. In the closed position, an electrical wire in the gap 190 is clamped against the conductive member 182 between the conductive member 182 and a wall of the second side 164 of each connector module 150. In this example, the second side 164 of the housing 160 acts as a clamping portion or body in combination with the conductive member 182. Accordingly, an electrical wire can be connected, e.g., physically and electrically connected, to the conductive member 182 in each connector module 150 when in the closed position.

Figure 4:
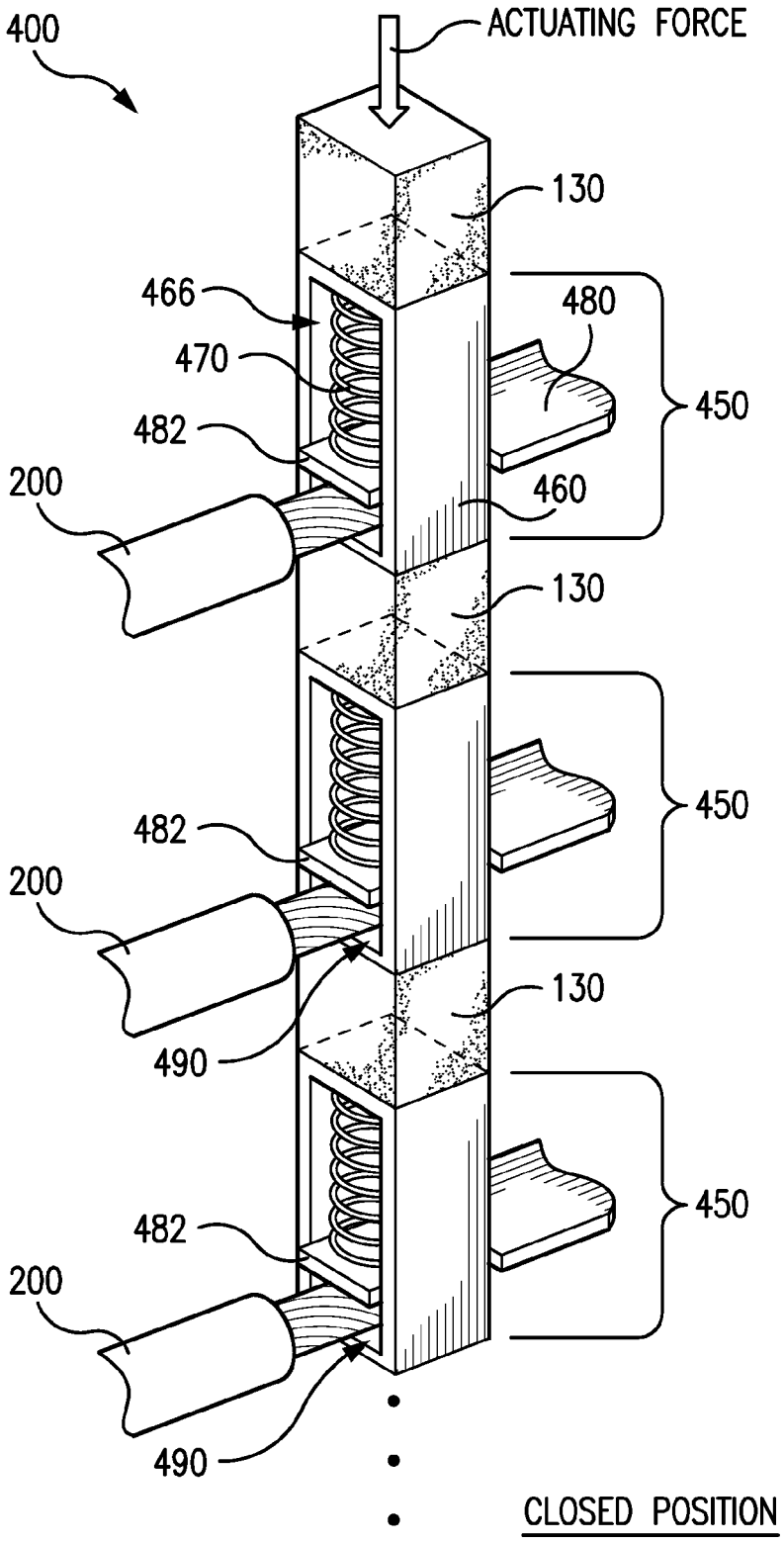
FIG. 4 illustrates a view of a multi-wire electrical connector system with a plurality of stacked connector modules in a closed position in accordance with a second embodiment of the present disclosure.

FIG. 4 illustrates a partial view of a multi-wire electrical connector system 400 in accordance with a second embodiment of the present disclosure. The connector system 400 can include a plurality of stackable spring-loaded connector modules 450, which similarly can be housed in a casing (110 of FIG. 1) and operated by a single actuator 120 as in the connector system 100 of the first embodiment (as shown in FIGS. 1 and 2). The connector system 400 can also include shuttles 130 adjacent to each connector module 450. Each connector module 450 includes a spring 470, such as a compression spring, and a conductive member 482 of a terminal 480, which are housed in a module housing 460. The connector system 400 is generally similar to the connector 100, except that the connector system 400 does not incorporate a spring holder for the spring 470 or a stop assembly in the housing 460. The spring 470 is configured to fit in a cavity 466 of the housing 460. The connector system 400 operates in generally the same manner as the connector system 100 of the first embodiment by using a single actuator (e.g., actuator 120 in FIGS. 1 and 2).

Figure 5:
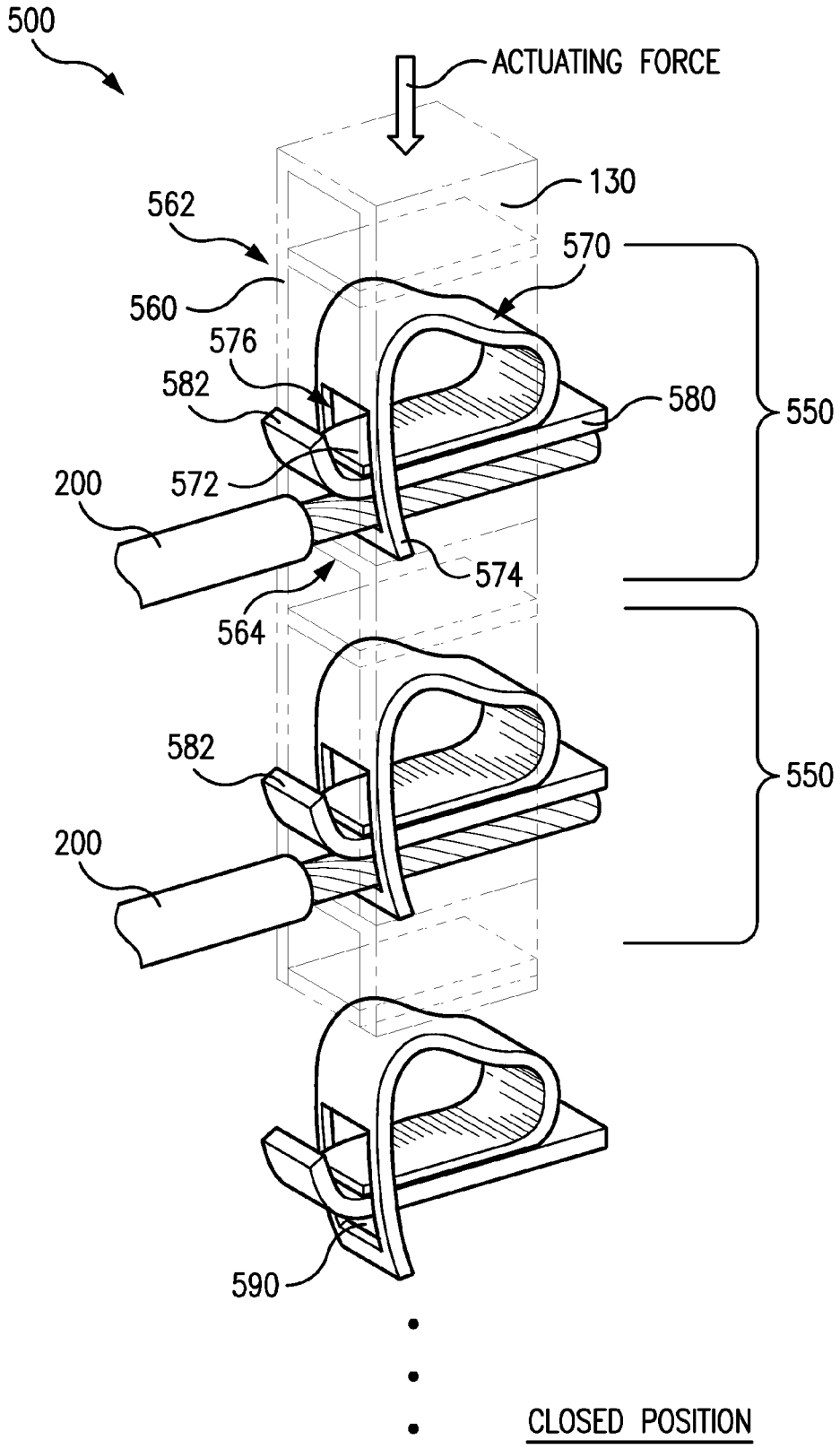
FIG. 5 illustrates a view of a multi-wire electrical connector system with a plurality of stacked connector modules in a closed position in accordance with a third embodiment of the present disclosure.

FIG. 5 illustrates a partial view of a multi-wire electrical connector system 500 in accordance with a third embodiment of the present disclosure. The connector system 500 can include a plurality of stackable spring-loaded connector modules 550, which can be housed in a casing (110 of FIG. 1) and operated by a single actuator 120 as in the connector system 100 of the first embodiment (as shown in FIGS. 1 and 2). As shown in FIG. 5, the connector system 500 can also include a shuttle 130 adjacent to a connector module 550. Each connector module 550 includes a spring 570 and a conductive member 582 of a terminal 580, which are housed in a module housing 560. The housing 560 includes a first side 562 and an opposing second side 564. In this example, the spring 570 includes a first end 572 and an opposing second end 574 with an opening 576. The spring 570 is looped so that the first end 572 extends through the opening 576 of the second end 574 and sits on top of the conductive member 582, which also has a portion thereof which extends through the opening 576.

The connector system 500 also operates in a similar fashion as the connector system 100 of the first embodiment by using a single actuator (e.g., the actuator 120 in FIG. 1). For example, an actuating force can be applied, via the single actuator, against the stacked connector modules 550 of the connector system 500. The resulting force causes the housings 560 of the stacked connector modules 550 to move relative to the casing (e.g., the casing 110 in FIG. 1) and the conductive members 582 of the terminals 580 toward the open position. At the open position, the spring 570 of each connector module 550 is compressed by the first side 562 of a corresponding housing 560 so the second end 574 of the spring 570 is forced toward the second side 564 of the housing 560. Given that the conductive member 582 is fixed relative to the housing 560, a gap 590 is formed immediately below the conductive member 582 in the opening 576 on the second end 574 of the spring 570 within each connector module 450.

Thus, in the open position, an electrical wire, e.g., electrical wire 200, can be inserted into or removed from the gap 590 in each connector module 550.

To operate the connector system 500 to the closed position, the actuating force applied against the stacked connector modules 550 of the connector system 500 is reduced or eliminated via the single actuator. The reduction or elimination of the actuating force causes the housings 560 to simultaneously move relative to the casing 110 and their conductive members 582 back into the closed position. At the closed position, an electrical wire 200 previously inserted through the gap 590 is clamped against the conductive member 582 inside of the opening 576 of the spring 570 between the conductive member 582 and a portion of the second end 574 of the spring 570 in the connector module 550. In this way, an electrical wire can be connected, e.g., physically and electrically connected, to a respective conductive member 582 in each connector module 550 in the closed position.

FIG. 5 is provided as one example of a connector module with a perforated flat form spring for a connector system. Other arrangements of FIG. 5 might include internal linkages (e.g., a plunger) and non-perforated flat form springs. For example, these additional linkages in each connector module can be used to compress the non-perforated flat form spring, as desired, when the single actuator (e.g., 120 in FIG. 1) is operated to the open or closed position. The non-perforated flat form springs can be configured in different sizes and shapes (e.g., a spring bent at an acute angle, etc.), and can be positioned in various locations within a housing of a connector module relative to the fixed terminal to apply suitable counter force when operating the connector system to the open or closed position.

The various multi-wire electrical connector systems described herein are provided as examples. The connector system can include any number of stackable connector modules and isolated terminals, and can be used to connect one electrical wire or separate electrical wires to separate terminals depending on the desired electrical configuration of the underlying electrical equipment. The connector system can be incorporated into various types of electrical equipment, such as a circuit breaker, contactor and electrical switch or any equipment that requires multiple electrical connections.

The various components of the connector system, such as the casing, housing and shuttles, can be formed of dielectric material, such as plastic. The casing can have a dimension to allow movement of stacked connector modules therein between the open and closed positions. To facilitate movement thereof, the casing of the connector system can incorporate rails or other guiding components for the stacked connector modules. The stackable connector modules and shuttles can also incorporate various mechanical configurations, such as tongue and groove, tab and slot and so forth between stacked components to facilitate stacking and connection thereof.

Furthermore, the single actuator for the connector system, described herein, can be any mechanical or electro-mechanical device which is able to controllably impart a desired actuating force to move the stacked connector modules (e.g., 150, 450, 550 and 650) to the open position or the closed position. In addition to a lever, the single actuator can, for example, be a screw or a cam. For example, a screw (or screw assembly) can be mounted onto the casing, with one end adjacent to the stacked connector modules. The screw can be rotated in a clockwise direction so that the end of the screw (or screw assembly) abuts and applies an actuating force against the stacked connector modules, or in a counter-clockwise direction to reduce or eliminate the actuating force against the stacked connector modules. In this way, the connector system is operable between an open or closed position. The screw can be rotated by hand or using a tool.

Although the connector systems in FIGS. 1-5 are shown as normally in the closed position when the actuator is not applying an actuating force, the connector system can also be configured to be normally in the open position when the actuator is not applying an actuating force. In addition, the housings for the stacked connector modules can be formed as a single unit with separate housing compartments to house the components (e.g., terminal and spring) for each connector module.

In addition, words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A multi-wire electrical connector system for electrical equipment comprising:

a plurality of stacked spring-loaded connector modules each including:

a housing, an isolated terminal to make an electrical connection with an electrical wire, the terminal having a fixed conductive member, the housing being movable relative to the fixed conductive member, and a spring, arranged inside the housing between a side of the housing and the fixed conductive member, to apply a spring force against the housing; and a single actuator to simultaneously operate all of the connector modules to an open position or a closed position, the open position allowing an electrical wire to be inserted into or removed from a housing of each connector module, the closed position allowing an electrical wire to be clamped against a terminal in each connector module, the single actuator applying an actuating force to the connector modules to move the housing of each connector module relative to a respective fixed conductive member into the open position or the closed position.

2. The system of claim 1, further comprising a casing for housing the connector modules, each of the fixed conductive members being fixed relative to the casing, the housings of the connector modules being movable relative to the casing via the single actuator.

3. The system of claim 1, wherein the single actuator contacts one end of the stacked spring-loaded connector modules to apply the actuating force, which moves the connector modules into the open position.

4. The system of claim 1, wherein the single actuator comprises a lever, screw or cam.

5. The system of claim 1, wherein the spring comprises a compression spring.

6. The system of claim 1, wherein each of the connector modules includes a spring holder for holding a respective spring in a respective housing.

7. The system of claim 1, further comprising a shuttle arranged on one end of the stacked spring-loaded connector modules or between two adjacent connector modules.

8. The system of claim 1, wherein each connector module clamps an electrical wire between the fixed conductive member of the terminal and a wall of the housing in the closed position.

9. The system of claim 1, wherein each connector module clamps an electrical wire between the fixed conductive member of the terminal and a portion of a respective spring clamp.

10. The system of claim 1, wherein the spring includes a first end and an opposing second end with an opening, the spring being looped so that the first end extends through the opening of the second end and sits on top of the conductive member.

11. The system of claim 1, wherein the actuating force applied by the single actuator is greater than the sum of the spring forces of the springs of the connector modules in the open position.

12. The system of claim 1, wherein the sum of the spring forces applied by the springs of the connector modules causes the connector modules to move to the closed position when the sum of the spring forces is greater than the actuating force applied by the single actuator.

13. The system of claim 1, wherein the housing of each of the connector modules comprises steel.

* * * * *